United States Patent [19]

Stannek

[11] 4,056,700

[45] Nov. 1, 1977

[54] KEYBOARD ASSEMBLY MOMENTARY CONTACT PUSH BUTTON SWITCH WITH TACTILE ACTION

[75] Inventor: Karl Heinz Stannek, Santa Ana, Calif.

[73] Assignee: Western Digital Corporation, Newport Beach, Calif.

[21] Appl. No.: 650,419

[22] Filed: Jan. 19, 1976

[51] Int. Cl.[2] ..... H01H 13/52

[52] U.S. Cl. ..... 200/159 R; 200/5 A; 200/67 DB; 200/76; 200/159 A; 200/243; 200/275; 200/340

[58] Field of Search ..... 200/5 R, 5 A, 16 A, 200/67 R, 67 D, 67 DA, 67 DB, 67 PK, 76, 159 R, 159 A, 159 B, 160, 165, 237–251, 275, 340

[56] References Cited

U.S. PATENT DOCUMENTS

| | | | |
|---|---|---|---|
| 1,006,394 | 10/1911 | Morrell | 200/159 A |
| 2,424,527 | 7/1947 | Whyte et al. | 200/159 A X |
| 2,755,352 | 7/1956 | Birkemeier | 200/67 DB |
| 2,923,787 | 2/1960 | Nelson | 200/159 A X |
| 3,544,987 | 12/1970 | McMann et al. | 200/241 X |
| 3,808,389 | 4/1974 | Ramsay et al. | 200/159 A |
| 3,818,170 | 6/1974 | Seidel | 200/165 |
| 3,849,611 | 11/1974 | Walker, Jr. | 200/275 X |
| 3,899,648 | 8/1975 | Murata | 200/67 DB X |
| 3,922,513 | 11/1975 | Kravchuck | 200/159 R |
| 3,959,611 | 5/1976 | Greene et al. | 200/159 B X |
| 3,997,745 | 12/1976 | Marquardt | 200/76 |
| 4,004,121 | 1/1977 | Twyford | 200/159 R X |
| B 376,654 | 1/1975 | Kravchuck | 200/159 R |

FOREIGN PATENT DOCUMENTS

| | | | |
|---|---|---|---|
| 559,966 | 3/1975 | Switzerland | 200/159 R |

*Primary Examiner*—James R. Scott
*Attorney, Agent, or Firm*—Richard H. Zaitlen

[57] ABSTRACT

A contact switch for momentary connection between conductors is disclosed. The switch has particular utility in a keyboard assembly, such as pocket calculators. In the first embodiment, the switch comprises a button member, and a sinusoidal-shaped spring. The spring is of a configuration such that reaction of the spring is stronger in its normal position than in its depressed state. This provides the user with a tactile feeling when the button is depressed. In the second embodiment, the button member is retained in an extended position by an associated buckle spring. This spring also provides the user with a tactile feeling.

38 Claims, 10 Drawing Figures

KEYBOARD ASSEMBLY MOMENTARY CONTACT PUSH BUTTON SWITCH WITH TACTILE ACTION

BACKGROUND OF THE INVENTION

1. Field of the Invention

This invention relates to the field of switching assemblies and, more particularly, to a momentary contact push button switch which has a tactile action and is adapted for use in keyboard assemblies.

2. Prior Art

There is a wide variety of devices having a keyboard assembly in which a plurality of depressable keys or push button switches are provided. One such device is the now popular "pocket calculator". The keyboard in such a device contains a plurality of switches each of which, when depressed, perform a separate operation. Because each switch may be depressed many times during the useful life of the calculator, the switch must be well constructed and not susceptible to excessive wear. Moreover, the large number of separate switches in a typical keyboard requires them to be made as simple and inexpensive as possible.

There are many types of push button switches which are designed to make electrical contact in various switch assemblies. For example, a conventional system is to provide a spring loaded key-switch combination in which the contact engagement has a "wiping" action. Such a system is shown by McMann et at, U.S. Pat. No. 3,544,987. While the switch of McMann does provide the desired electrical making and breaking of a circuit, such mechanisms are characterized by their expensive and complex construction, and because of the wiping action, tend to have excess wear and easy failure of the parts. For example, in the switches of McMann et al, as the button member is depressed, the sinusoidal-shaped spring is caused to extend or flex outward as the arms of the spring move into their desired position. When pressure is removed from the button, the spring once again moves back into its unflexed position. One can easily see that in such a system, the wiping action of the spring against the contact members causes the spring to wear out quickly. Moreover, there is no "feeling" associated with such a device which provides the user with an indication that the desired contact is being made.

Another type of push button switch for use in keyboard switching assemblies is disclosed by Walker, U.S. Pat. No. 3,849,611. In the invention of Walker, the switch includes a contact bar and spring contact leads cantilevered above and across the contact bar. When the button member is depressed, each of the spring leads is deformed downward and across the desired contact with a wiping action across the bottom of the button. This type of assembly also suffers from the shortcoming associated with the assembly of McMann in that there is still the same wiping action only in this case the wiping action is on the button member as opposed to the contact. And there is no "feel" in relation to making the desired contact. Moreover, the assembly of Walker requires that the spring members be coupled to the board and the button member installed separately. This is expensive and requires complex assembly steps. In most typical keyboard switch assemblies in which a plurality of keys are provided for independent operation in response to manual depression thereof, it is especially desirable to provide each push button or key with the requisite "feel" of making contact when the button is depressed. This enables the user to know that information has been inserted into the machine. Such a switch is referred to as having a "tactile" feel. Switches of this type, usually containing a spring, require an initial force to overcome the resistance of the spring, but then much less force to hold the spring down.

One prior art switch which discloses a means for obtaining the desirable tactile feel is Weidenman, U.S. Pat. No. 2,066,022. In the thumb switch of Weidenman, a uniquely designed spring which is shaped, in part, to a form of a "Witch of Agnes" is disposed at the end of a movable plunger member. When the plunger member is depressed the spring flexes inward but only after sufficient force is applied. It should be noted, however, that this type of switch would not be applicable in a keyboard assembly inasmuch as the spring is not designed to permit the plunger to contact any surface disposed thereunder. Moreover, there is no teaching in Weidenman of how to modify his switch such that it could be used in keyboard assemblies and the like.

The present invention is directed towards a unique push button switch designed to make a low current and low voltage connection from one conductor to another. By the use of the present invention a simple, yet effective solution to the aforementioned problems associated with prior art push button switches are overcome.

SUMMARY OF THE INVENTION

The present invention is directed toward spring actuated push button switches which have tactile action and their use in keyboard assemblies. Such switches are comprised of a button member and an associated spring. The spring must have a specific configuration and be disposed in the keyboard in a specific manner.

The first embodiment of the present invention is directed toward a spring actuated push button switch for use in a keyboard assembly comprising (i) a button member having means for retaining a spring; (ii) a resilient spring having a sinusoidal shape comprised of two arcuous branch members forming a central, downwardly extending trough member; and (iii) a contact bridge disposed in the button member adjacent the bottom thereof and having arm members adapted to electrically engage "contacts" or "staples" on the keyboard. The push button switch is arranged and configured such that, when the button member is depressed, the spring flexes downward and the contact bridge comes in contact with the staples on the keyboard.

The button members is of a generally rectangular configuration with an outwardly extending ledge member terminating in a downwardly extending rim. The ledge member and the rim form the surrounding walls of a cavity on the bottom of the button member. Disposed on the inside surface of the rim are slots or other means for retaining the spring member therein. The button member is secured in a typical keyboard assembly so as to extend upward through a rectangular opening therein with the ledge members selectively engaging the top of the assembly adjacent the rectangular opening.

The spring member represents one of the unique aspects of the present invention. It is inserted between the slots in the cavity of the button member and provides a switch with the above-described "tactile" action. This spring has a generally sinusoidal shape formed of three curved sections with the center section extending downward and disposed against the surface of a printed circuit in the keyboard assembly. Thus, the button member is selectively retained in an extended position between the top framework of the keyboard assembly and the circuit board by the spring member, and prevented from further extension upwardly by the ledge member abutting against the top framework.

The presently invented switch also includes a contact bridge yieldably engaged in the button member in the cavity area between opposite sides of the rim. The contact bridge has downwardly extending arm members which are arranged and configured such that, when the button member is depressed, the arm members straddle the spring and make contact with at least one staple on the circuit board.

The three elements of the switch of the first embodiment of the present invention are thus securely contained within the button member. Moreover, the simplicity of each of the elements means the switch can be easily and economically constructed. Finally, the action of the switch in making contact does away with the prior art wiping action and, therefore, prevents device failure due to excessive wear.

In the second embodiment of the present invention, a similar spring actuated push button switch as that described in the first embodiment of the present invention hereinabove is presented. The second embodiment is also directed to a uniquely shaped spring having the aforementioned tactile action. In this embodiment, however, the spring is a buckle spring and operates (i) to selectively retain the button member in an extended position, and (ii) to make an electrical connection between desired staples. Because the buckle spring performs two functions, there is no need for the contact bridge described with reference to the first embodiment. Thus, the buckle spring is a further improvement over the prior art and a point of novelty of the second embodiment of the present invention.

The spring actuated push button switch and the keyboard assembly of the second embodiment comprises at least one push button member having an extended and a depressed position. The button member is preferably of a generally rectangular configuration with an outwardly extending ledge member terminating on two opposed sides thereby forming a downwardly extending rim. The button member also has a protuberance on the bottom surface thereof for depression of the buckle spring when the button member is pushed downward.

The buckle spring of the present invention is disposed in the keyboard assembly so as to be engaged by the button member when depressed. The buckle spring of the present invention has a generally flat top with downwardly extending ends on either side thereof. Such a spring, when depressed, forms a downwardly extending trough member. This trough member serves to electrically couple a predetermined number of staples, for example, by electrically bridging two staples, each of which have been formed and soldered on a printed circuit board.

It should be noted that in the second embodiment of the present invention, the top framework of the keyboard assembly has a plurality of support members forming openings through which the button members extend. These support members also have slots or other means for retaining said spring therein.

By use of the second embodiment of the present invention simplicity of design and construction is achieved without sacrificing the tactile feel of the switch.

It is, therefore, one object of the present invention to produce a spring actuated push button switch which is simple to construct.

Another object of the present invention is to provide a push button switch which has the proper action and feel when used.

Yet another object of the present invention is to provide a push button switch having all the necessary components disposed in one cohesive unit.

The novel features which are believed to be characteristic of the invention, both as to its organization and method of operation, together with further objectives and advantages thereof, will be better understood from the following description considered in connection with the accompanying drawings in which a presently preferred embodiment of the invention is illustrated by way of example. It is to be expressly understood, however, that the drawings are for the purpose of illustration and description only and are not intended as a definition of the limits of the invention.

DETAILED DESCRIPTION OF THE INVENTION

Figure 1:
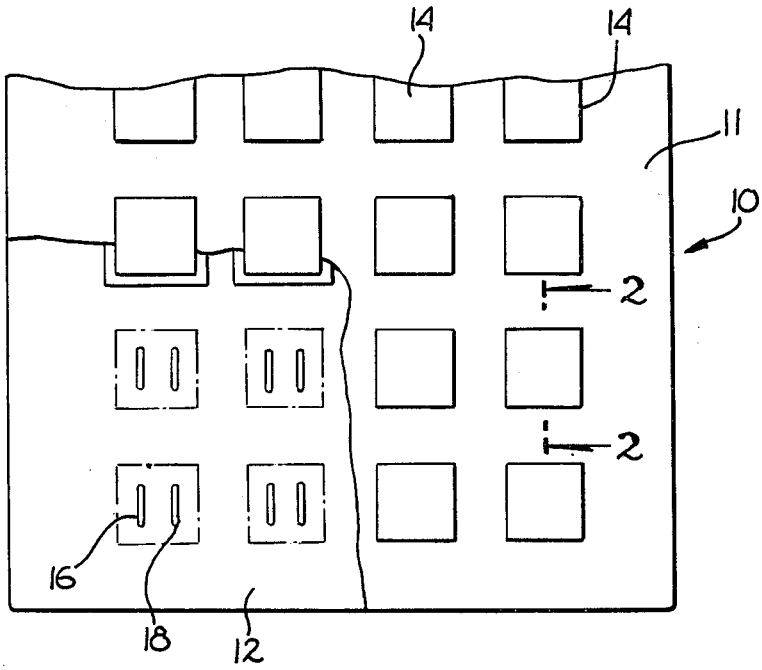
FIG. 1 is a plan view, partially broken away, illustrating a keyboard switching assembly and showing the staple members disposed on a typical circuit board.

Referring first to FIG. 1, a typical keyboard switch assembly 10 is shown. The assembly has a top framework 11, covering a printed circuit board 12. In such an assembly a plurality of keys or buttons 14 are arranged in a predetermined pattern depending on the function of the assembly. Such buttons are held in position between the top framework 11 and the circuit board 12. They extend upward through the framework 11 through generally rectangular openings disposed therein although other configurations may be employed. The framework 11 has been partially removed to illustrate that various staples 16 and 18 are disposed on the circuit board 12. The present invention will first be described with reference to the first preferred embodiment shown in FIGS. 2–7.

Figure 2:
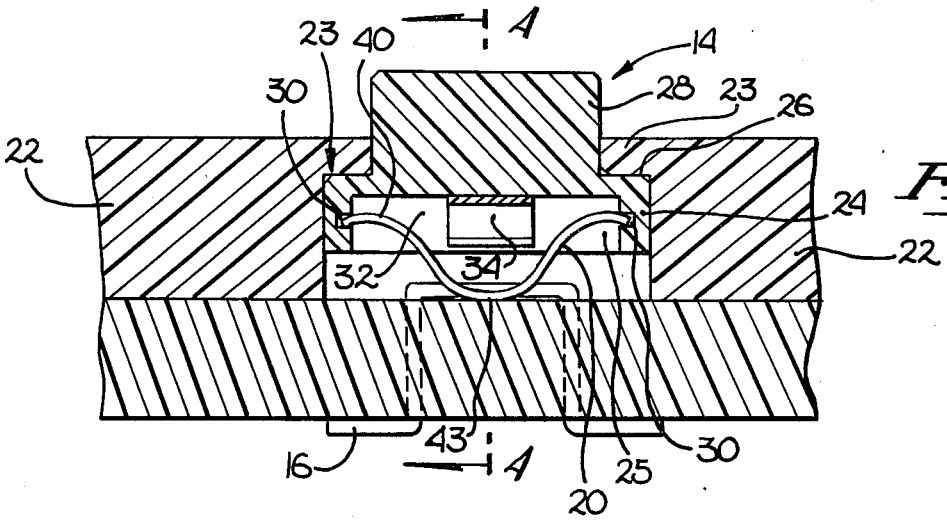
FIG. 2 is a sectional view of the first embodiment of the push button switch of the present invention taken along section lines 2—2 of FIG. 1.

Indicated in FIG. 2, the typical means for retaining button 14 in a switch assembly is to provide the top framework 11 with various upwardly extending support members 22. In the preferred embodiment framework 11 and support members 22 are of one-piece construction and are often referred to as the "key retainer". Support members 22 are integrally formed on the top framework 11 and are selectively coupled to the circuit board 12 by adhesives, pins or thermoforming the parts together. Support members 22 have outwardly, generally horizontal arms 23 which yieldably engage the button 14. Of course, other means for retaining button 14 in a keyboard are within the scope of this invention.

Today many pocket type calculators have a plurality of buttons with each button indicating a numeral or an indication of a function to be performed on the numerals, such as, for example, "add", "subtract", etc. When the user desires to operate the assembly, a number of the buttons are pressed in order to obtain the desired result. Many of these types of calculator require contacts to be made between one, two or more electrical staples, such as staple 16 and staple 18. When the user would press down on button 14, the button member would cause staple 16 and staple 18 to become electrically coupled to one another thereby activating a specific function of the calculator.

As pointed out hereinabove, one of the problems associated with the prior art switches was that there was no "feel" in relationship to pressing the button and making contact between the desired contacts. Some prior art assemblies provided some sort of clicking noise and some had a complicated mechanical action which provided a soft or spongy feeling when the button was depressed. To overcome this problem to "feel" as well as make a simpler and less expensive switch, the present invention couples a uniquely shaped spring 20 directly to the button as shown in FIG. 2. The button member has a generally rectangular top 28 and an outwardly extending ledge 26 terminating in a downwardly extending rim 24. The rim 24 has slots 30 disposed on the inside surface thereof for retaining the resilient spring 20 therein. The rim 24 and the ledge 26 form a cavity 25 into which the spring 20 is inserted. In the presently preferred embodiment, the spring 20 extends across the cavity 25 and matingly engages slots 30 on opposite sides of rim 24. Other means for retaining the spring in the button are within the scope of this invention. It should be noted that spring 20 keeps the button member 14 firmly extending up through rectangular openings in the framework 11 when the spring is in its normal position.

One can see in FIG. 2 that spring 20 is comprised of two outwardly extending arcuous branch sections 40 and 42 separated by a generally U-shaped, central trough section 43. As hereinafter further described, spring 20 has tactile action feel, that is, more force is needed to overcome the force of the spring in its normal position in order to flex it than to keep the spring in its flexed state.

Figure 7:
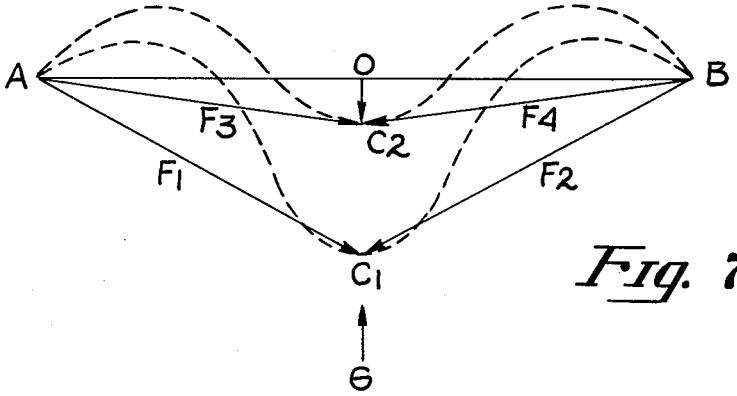
FIG. 7 is a representation of the flexing action of the spring shown in FIGS. 2 through 6.

The force of spring 20 in its normal position compared with its extended state is shown in FIG. 7 and is represented by the following formula:

$$(F_1 + F_2) \sin OAC_1 = (3.5 \pm 1/5)(F_3 + F_4) \sin OAC_2$$

As shown in FIG. 7, the relative forces associated with depressing and extending the spring 20 are presented. A-B represents the straight line length of the spring with 0 being center point. $F_1$ through $F_4$ represent various indicated vector forces on the spring in the compressed and extended positions. One can see that when the trough occupies the position $C_1$ a specific force is necessary to bring the spring into position $C_2$. However, once in position $C_2$, the force acting on the spring (represented by the line $OC_2$) is diminished. While the diagram indicates the ends of the spring being held stationary, the same force diagram applies to spring 20 wherein branches 40 and 42 are flexed and trough 43 is stationary. Moreover, according to the spring dimensions and material selected, the spring forces are adjustable.

From the force diagram of FIG. 7, one can see that the initial force to depress branches 40 and 42 would be greater than the force required to keep these branches depressed. Such a spring keeps the button member 14 firmly extended, and enables the user to get a feel of an initial effort corresponding to the actual depression of the button. This also insures that once the button member has moved beyond a certain point in its downward travel, after the application of the initial effort, the switch then accelerates or "toggles" into the closed position.

Also disposed in cavity 25, adjacent the bottom of top 28, is contact bridge 32. This is most clearly seen in FIGS. 4 and 5. Contact bridge 32 has arm members 34 which are disposed on both sides of a central region 36. Arms 34 extend downward and are arranged and configured to make an electrical contact between, for example, staples 16 and 18. Should only one contact arm be needed because of the arrangement on the circuit board, other configurations of the contact bridge can be used and are within the scope of this invention.

Figure 6:
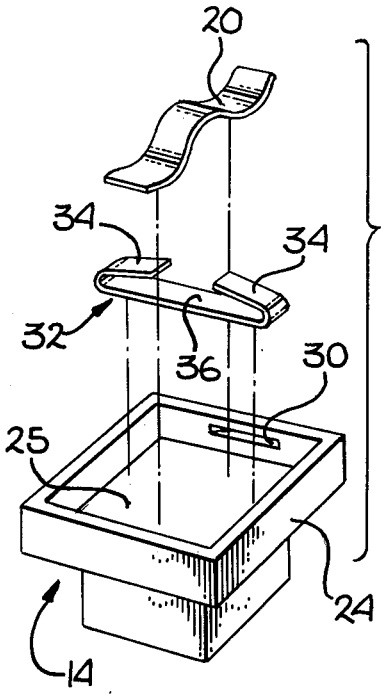
FIG. 6 is an exploded perspective view showing the button member, the contact bridge, and the sinusoidal shaped spring.

Shown in FIG. 6, a perspective view illustrates the preferred configuration of the button member 14, the spring 20, and the contact bridge 32, all upside down. Typically, button 14 has the indicated rectangular rim 24 with the contact bridge yieldably secured between opposite sides of the rim in the cavity 25. No other means for securing the contact bridge 32 in cavity 25 is required, although other means, such as, for example, adhesives, pins and the like can be used. The spring 20 is disposed in the button member 14 atop the contact bridge 32 and between the downwardly extending arms 34. In the preferred embodiment, the longitudinal direction of the spring 20 and the contact bridge 32 are generally perpendicular with respect to each other.

As to specific materials for each of the three elements of the present invention, the button 14 is usually a nonconductive material, such as plastic and the like. The contact bridge 32 and the spring 20 are generally made of resilient metal, such as, for example, stainless steel and the like. It is important that contact bridge 32 be made of an electrically conductive material in order for the requisite electrical contacts to be made. The button 14 has been described in its extended position in the keyboard assembly 10.

Figure 3:
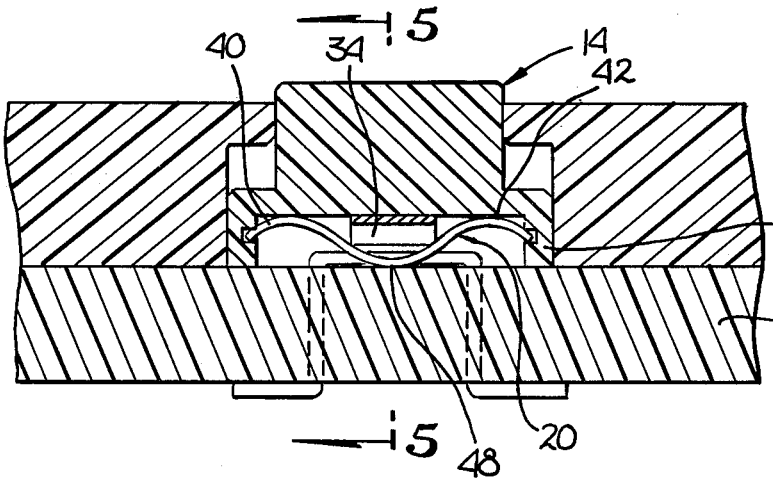
FIG. 3 is another sectional view of the push button switch shown in FIG. 2 with the button member depressed.
Figure 4:
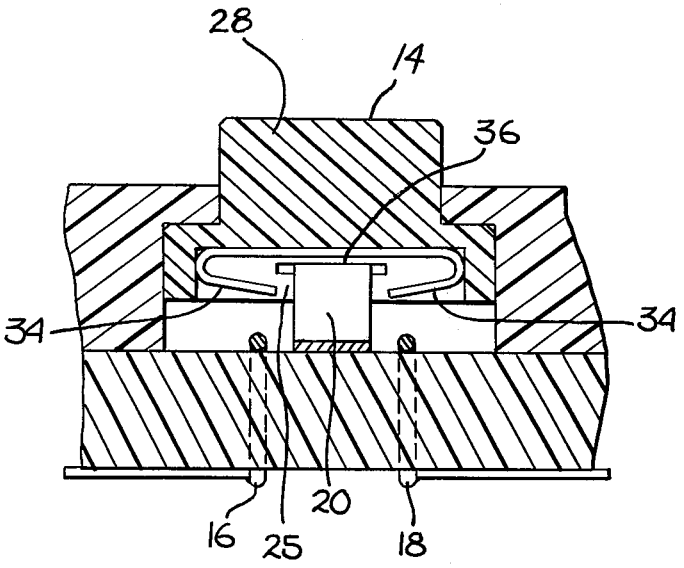
FIG. 4 is a sectional view of the push button switch shown in FIG. 2 taken along lines 4—4 showing the contact bridge member.
Figure 5:
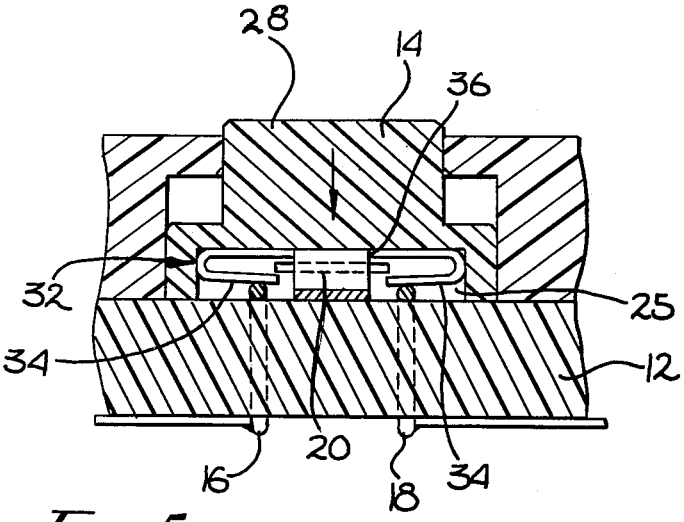
FIG. 5 is a sectional view of the push button switch shown in FIG. 3 taken along lines 5—5 showing the contact bridge in the depressed position.

Now referring to FIGS. 3 and 5, the button 14 is shown to have been pushed downward into its depressed position, thereby causing spring 20, and more particularly branches 40 and 42, to be extending downward. The button is permitted to travel downward sliding against supports 22 until rim 24 abuts the board 12. Rim 24 has a predetermined height such that contact between arms 34 and staples 16 and 18 is achieved. Note that spring 20 fits between the arms 34 into area 36. This arrangement prevents snagging of the arms 34 and the spring 20.

It can be seen that when the button 14 is depressed inward against the resistance of the spring 20, the force acting on the spring is represented by the arrow G shown in FIG. 7. The spring is designed such that the initial force to be overcome in depressing the button is much greater than the force needed to retain the button in its depressed state. This gives the user the above-described "tactile" feeling of activating the contact, i.e. as the button 14 is disposed downward, the contact bridge comes into contact with the desired staples 16 and 18 and electrically joins them. When the staples are electrically joined, the spring has now been compressed to position $C_2$ indicated in FIG. 7. At this point, the force on the spring 20 is diminished meaning that once the spring is flexed downward, it is easy to hold the button 14 in this position.

From the above-described operation of the first embodiment of the invented switch, one can see that spring 20 is only flexed at each end thereof. And because trough 43 remains in contact with the board 12 at all times, only branches 40 and 42 are subject to any flexing action. Note however, that there is an absence of any wiping action by the spring against the contacts. While contact arms 34 do abut against staples 16 and 18, such action is completely different from the wiping action associated with prior art switches. Moreover, arms 34 are only slightly flexed as they make contact. Thus, both the spring 10 and the contact bridge 32 are not subject to excessive wear and can remain in use long after their prior art counterparts.

Figure 8:
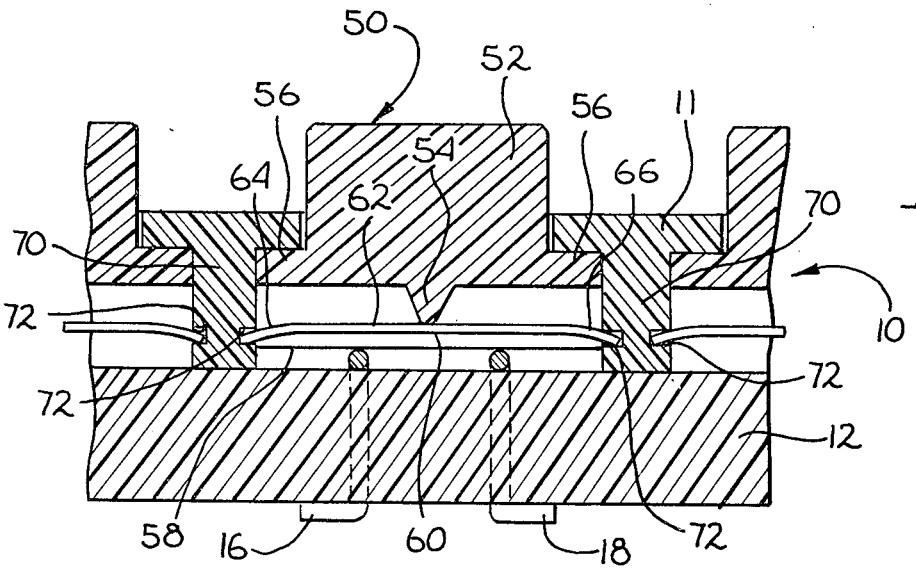
FIG. 8 is a sectional view of the second embodiment of the present invention showing the button member, the spring member, and how such members are retained in a keyboard assembly.

The second embodiment of the present invention will be described with reference to FIGS. 8–10. In the second embodiment of the present invention, the tactile action is produced by a second uniquely shaped spring. This spring is clearly shown in its extended or unflexed position in FIG. 8 as element 60, and in its flexed or extended position in FIG. 9. Such a spring is hereinafter sometimes referred to as a "buckle" spring. Buckle spring 60 has 2 generally downwardly extending ends 72, and a generally flat horizontal section 62. Referring to FIG. 8, one can see that buckle spring 60, in its unflexed position, has its ends 72 disposed in the keyboard assembly, amd more specifically, in the upwardly extending support members 70.

Button member 50 is similar in shape and design to that described with reference to the button member 14 of the first embodiment. It has a generally rectangular top 52 with an outwardly extending ledge 56 terminating in a downwardly extending rim 58. However, inasmuch as there is no need for any contact bridge, the downwardly extending rim 58 of button 50 need not extend completely around the circumference of the button. In fact, rim 58 is only found on two opposed sides of button 50 so as to permit the spring 60 to extend completely across and be selectively coupled to the arms 70. The other distinct feature of button 50 is that there is a protuberance 54 disposed on the bottom thereof. Protuberance 54 is arranged and configured to selectively engage the buckle spring 60 when the top 52 of the button member 50 is disposed downward. Of course, other means for causing the spring to be flexed downward are also within the scope of this invention, such as, for example, a spike-shaped member, a rounded member, and the like.

Button 50 and buckle spring 60 are arranged and configured to be held in slidable position between associated support members 70, i.e. rim 58 of the button member 50 abuts supports 70 so as to be in a sliding relationship therewith. The button 50 is disposed on top of the spring 60 with the spring disposed in a substantially horizontal plane adjacent the bottom of the button 50. Support members 70 have a generally upward extended "T"-shape terminating in outwardly extending arm members 74. Arm members 74 extend over the ledge 56 on all sides (see FIG. 10), and thereby limit the upward direction of travel of button 50. It is understood that other means for retaining button 50 in slidable position and for retaining the upward movement are within the scope of this invention, such as, for example, clips, prong members and the like.

Figure 9:
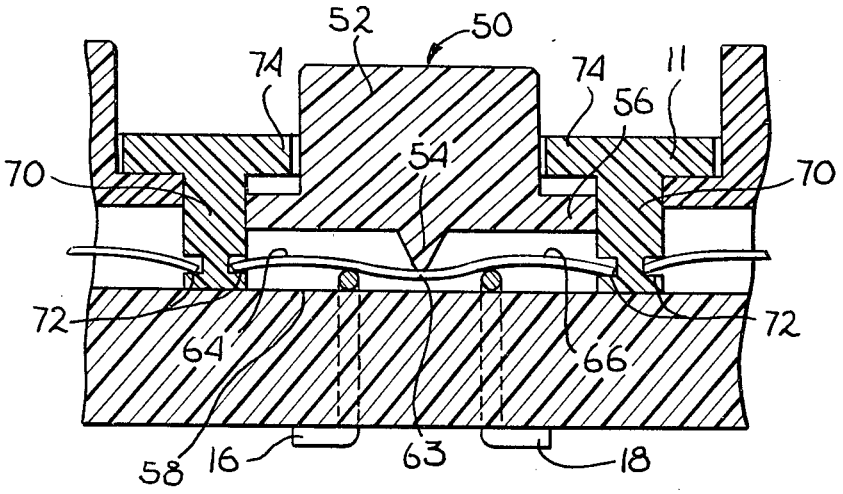
FIG. 9 is a sectional view showing the button member depressed thereby causing the spring member to engage the desired electrical staples.

As shown in FIG. 9, when the top 52 is disposed in the downward direction, the protuberance 54 engages buckle spring 60 generally near the center thereof and causes a trough section 63 to be formed therein. Two generally upwardly the spring 60 is disposed downward. However, inasmuch as members 64 and 66 are disposed in slots or other retaining means 72 on support members 70, the spring 60 is held in position. As one can see, when the spring is disposed downward, the trough section 63 engages staples 16 and 18 thereby forming an electrical path between them. It should be noted that slots 72 are disposed on the support member 70 at a specific height such that the buckle spring 60 is not allowed to completely buckle and extend in a completely downward-facing direction. The specific arc of branch members 64 and 66 is chosen such that after the spring 60 is depressed, it will flex back into its original position. Because of this aspect, once the button 50 is released, the buckle spring 60 returns the button 50 to its original upward extending position.

To prevent buckle spring 60 from being disposed too far in the downward direction, the button member 50 has downwardly extending rim members on opposite sides thereof of a predetermined height. This is most clearly shown in FIG. 10. When rim members 58 engage the printed circuit board 12, the button member is thereby restricted from further movement in the downward direction. This permits spring 60 to flex back into its original position thereby forcing button 50 upward.

Figure 10:
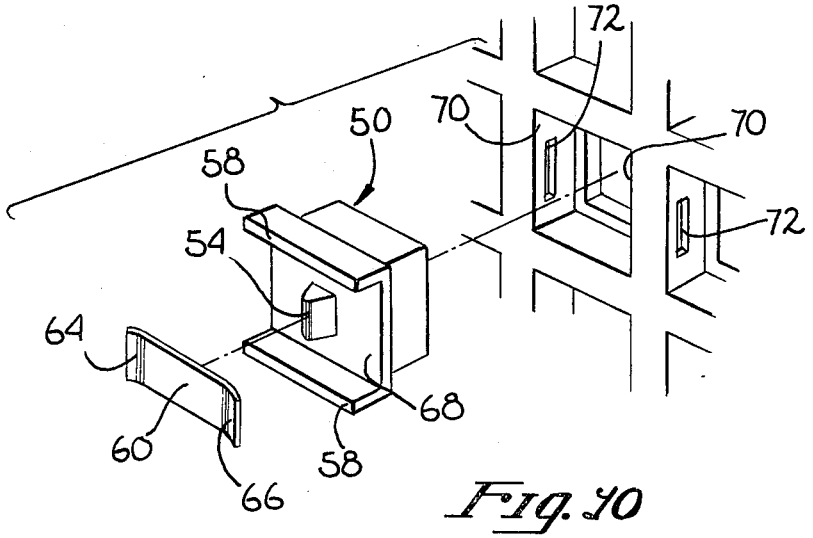
FIG. 10 is an exploded perspective view showing how the button and spring fit into the keyboard.

Referring now to FIG. 10, one can see that the button member is positioned in the framework 11 and extends upward through the framework 11 from the bottom thereof. Inasmuch as the ledge 56 completely surrounds the button member 50, the button member 50 is retained on all sides by the corresponding arm members 74 (see FIG. 9). After the button member 50 is in position, the ends 64 and 66 of the buckle spring 60 are yieldably engaged in the slots 72 disposed on supports 70. Because the buckle spring 60 in its normal position is disposed upward, the button member is retained in its upwardly extending position in its normal state. Thus, the user always knows when the button is functioning properly inasmuch as it will be extending upward in its normal unflexed state. The user will, therefore, know that only when the button member is depressed, will it assume a position substantially lower than the position of all of the remaining button members. Thus, in the second embodiment of the present invention, the buckle spring 60 retains the button 50 in an extending position in the keyboard assembly and make the upwardly desired electrical path between the staples 16 and 18. This dual function, therefore, permits the switch of the second embodiment to be manufactured without any contact bridge or other further components. This then decreases costs and increases the simplicity of the final keyboard assembly.

There has been described a unique push button switch. It is to be understood, that the button member, contact bridge and spring can be used in other embodiments than in keyboard switch assemblies. And other configurations of the button, spring, and contact bridge are within the scope of this invention. For example, the button need not necessarily be rectangular in shape, and other shapes, such as, polygonal, round, and the like are also within the scope of this invention. While the unique contact push button switch has been described with reference to a particular embodiment, the principles involved are susceptible of other applications which are readily apparent to persons skilled in the art. This invention, therefore, is not intended to be limited to the particular embodiment herein disclosed.

I claim:

1. A spring actuated push button assembly for use in an associated keyboard assembly and which keyboard assembly includes a plurality of electrical staple elements, said push button assembly adapted to provide the user with a tactile feel when said switch is depressed comprising:

a button member having an outwardly extending ledge terminating in a downwardly extending rim, said ledge and said rim forming a cavity area adjacent the bottom of said button member;

means for electrically engaging said keyboard assembly; and a shaped spring having a flexed and an unflexed position, said spring disposed in said cavity such that when said button member is depressed, said spring moves into said flexed position thereby providing said user with a tactile feel, and when said button member is released, said spring moves into said unflexed position thereby causing said button to be disposed upward.

2. The push button assembly of claim 1, wherein said means for electrically engaging said keyboard assembly is a contact bridge, said contact bridge having arm members arranged and configured to come into electrical contact with said staple elements disposed in said keyboard.

3. The push button assembly of claim 2, wherein means for retaining said spring in said button member are disposed on the inside surface of said rim.

4. The push button assembly of claim 1, wherein said means for electrically engaging said keyboard assembly is a trough-shaped section of said spring.

5. The push button assembly of claim 4, wherein said trough-shaped section of said spring is formed when said button member is depressed and engages said spring near the center thereof.

6. The push button assembly and keyboard of claim 5, wherein said button member has means for depressing said spring, said means being disposed on said button member adjacent the bottom surface thereof.

7. The push button assembly of claim 6, where said means is a protuberance.

8. The push button assembly of claim 2, wherein said arm members are downwardly extending and are arranged and configured such that when said button member is depressed, said arm members are disposed adjacent each side of said spring.

9. The push button assembly of claim 1, wherein said spring has a sinusoidal shape comprised of two arcuous branch sections forming a downward extending trough section.

10. The push button assembly of claim 1, wherein said spring has a generally flat section and downwardly extending ends on each side thereof.

11. The push button assembly of claim 1 wherein a section of said spring forms said means for electrically engaging said keyboard assembly.

12. The push button assembly according to claim 11 wherein said means for electrically engaging said keyboard assembly is a trough-shaped section of said spring selectively formed when said spring is depressed.

13. The push button assembly according to claim 12 wherein said spring has a generally flat section and downwardly extending ends on each side thereof, said flat section forming said trough-shaped section when said spring is depressed.

14. The push button assembly according to claim 11 wherein said button assembly is disposed in mounting means for retaining said button assembly, said mounting means having support members coupled to a bottom circuit board, said button assembly disposed in said mounting means with said support members yieldably engaging said ledge member.

15. The push button assembly according to claim 14 wherein said electrical staple elements are disposed on said circuit board.

16. The push button assembly according to claim 14 wherein said support members form a plurality of openings with an associated button assembly disposed in each opening.

17. The push button assembly according to claim 14 wherein said support members include means for retaining said spring member therein.

18. A spring actuated push button switch keyboard adapted for use in a keyboard assembly which assembly includes a plurality of electrical staple elements comprising:

a button member and an associated spring, said button member having means for retaining said spring therein; and a contact bridge disposed in said button member adjacent the bottom thereof, said contact bridge having arm members adapted to electrically engage said keyboard;

wherein said spring is so disposed in said button member such that when said button is depressed, said arm members of said contact bridge come into electrical contact with said staple elements disposed in said keyboard.

19. The push button switch of claim 18, wherein said spring has a sinusoidal shape comprised of two arcuous branch sections forming a downward extending trough section.

20. The push button switch of claim 19, wherein said buttom member has an outwardly extending ledge terminating in a downwardly extending rim.

21. The push button switch of claim 20, wherein means for retaining said spring in said button member are disposed on the inside surface of said rim.

22. The push button switch of claim 19, wherein said switch is disposed in mounting means for retaining said switch, said mounting means having support members coupled to a bottom circuit board, said switch being disposed in said mounting means with said support members disposed over said ledge member of said button member and yieldably engaging said ledge, and said trough section of said spring engaging said bottom circuit board.

23. The push button switch of claim 22, wherein said electrical staple elements are disposed on said circuit board.

24. The push button switch of claim 18, wherein said arm members are downwardly extending and are arranged and configured such that when said button member is depressed, said arm members are disposed adjacent each side of said spring.

25. The push button switch of claim 18, wherein said button is made of a nonconductive material.

26. A momentary contact push button switch having tactile action for use in a keyboard assembly, which keyboard assembly includes a plurality of electrical staple elements comprising:

a button member having an outwardly extending ledge at the bottom thereof terminating in a downwardly extending rim;

a contact bridge disposed in said button member, said contact bridge having downwardly extending arm members for making an electrical contact with said staple elements; and a sinusoidal-shaped spring having two arcuous branch sections forming a central, downward extending trough section, said branch sections coupled to said rim on the inside surface thereof such that when said button member is depressed, said arm members on said contact bridge come into electrical contact with predetermined staple elements.

27. The push button switch of claim 26, wherein said two branch sections are disposed in slots located on the inside surface of said rim.

28. The push button switch of claim 26, wherein said switch is disposed in mounting means for retaining said switch, said mounting means having support members coupled to a bottom circuit board, said switch being disposed in said mounting means with said support members disposed over said ledge member of said button member and yieldably engaging said ledge, and said trough section of said spring engaging said bottom circuit board.

29. The push button switch of claim 28, wherein said electrical staple elements are disposed on said circuit board.

30. The push button switch of claim 26, wherein said button is made of a nonconductive material.

31. A momentary contact push button switch disposed in an associated keyboard assembly which keyboard assembly includes a plurality of electrical staple elements comprising:

a button member having an outwardly extending ledge member at the bottom thereof terminating in a downwardly extending rim;

a contact bridge disposed in said button member, said contact bridge having downwardly extending arm members for making an electrical contact with said staple elements; l a sinusoidal-shaped spring having two arcuous branch sections forming a central, downward extending trough section, said branch sections coupled to said rim on the inside surface thereof such that when said button member is depressed, said arm members on said contact bridge come into electrical contact with said staple elements; and wherein said keyboard assembly is comprised of a top framework having a plurality of openings for said button members, and a bottom circuit board coupled to said top framework, said top framework having outwardly extending arm member for engaging and retaining said button member therein, and said bottom circuit board containing said stape elements.

32. The push button switch and keyboard of claim 31, wherein said outwardly extending arm members of said top framework engage said ledge member of said button member.

33. The push button switch and keyboard of claim 31, wherein said spring is disposed beneath said contact bridge generally between said downwardly extending arm members.

34. The push button switch and keyboard of claim 31, wherein said top framework has a plurality of support members forming said opening.

35. The push button switch and keyboard of claim 31, wherein said spring has first and second ends, said ends being disposed in slots located on the inside surface of said rim.

36. The push button switch and keyboard of claim 35, wherein said spring is disposed in said slots, said slots being disposed on opposite sides of said rim.

37. The push button switch and keyboard of claim 35, wherein said button member has means for depressing said spring, said means for depressing said spring being disposed on said button member adjacent the bottom surface thereof.

38. The push button switch and keyboard of claim 37, where said means is a protuberance.

* * * * *